US006426587B1

(12) United States Patent
Hell et al.

(10) Patent No.: US 6,426,587 B1
(45) Date of Patent: Jul. 30, 2002

(54) THERMIONIC EMITTER WITH BALANCING THERMAL CONDUCTION LEGS

(75) Inventors: Erich Hell, Erlangen; Manfred Fuchs, Nuremberg; Markus Schild, Erlangen, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/557,769

(22) Filed: Apr. 25, 2000

(30) Foreign Application Priority Data

Apr. 29, 1999 (DE) ..... 199 19 620

(51) Int. Cl.[7] ..... H01J 35/06
(52) U.S. Cl. ..... 313/341; 313/346 R; 313/344
(58) Field of Search ..... 313/341, 346 R, 313/344

(56) References Cited

U.S. PATENT DOCUMENTS 2,919,373 A 12/1959 Riley et al.
4,878,866 A 11/1989 Mori et al.
6,115,453 A * 10/2000 Hell et al. ..... 378/136

FOREIGN PATENT DOCUMENTS

| | | |
|---|---|---|
| DE | PS 27 27 907 | 11/1987 |
| FR | 978 627 | 4/1951 |
| GB | 1011398 | 11/1965 |

* cited by examiner

*Primary Examiner*—Vip Patel
*Assistant Examiner*—Ken A Berck
(74) *Attorney, Agent, or Firm*—Schiff Hardin & Waite

(57) ABSTRACT

A thermionic emitter has a flat emission surface that is subdivided by slits into generally spiral or serpentine conductor sections, the surface having legs extending therefrom that form part of the current supply terminals and that also serve for securing the emitter. Each of these legs has a portion with a longitudinal electrical resistance that is elevated compared to that of the conductor sections, such that areas of maximum temperature migrate from the middle of the emitter to its edges as the heating current increases.

6 Claims, 1 Drawing Sheet

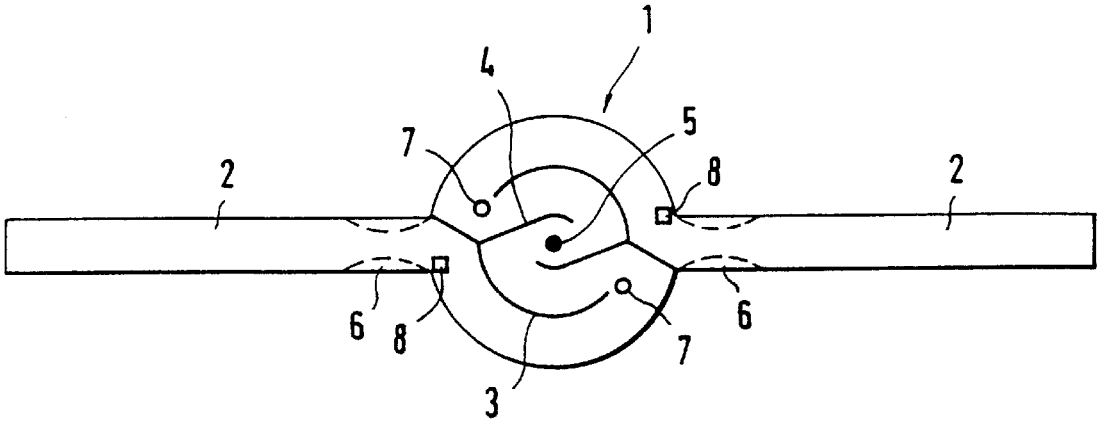
1
4
5
7
8
2
2
6
8
6
7
3

THERMIONIC EMITTER WITH BALANCING THERMAL CONDUCTION LEGS

BACKGROUND OF THE INVENTION

1. Field of the Invention

The present invention relates to a thermionic emitter of the type a substantially flat emission surface that is subdivided into conductor sections or interconnects and legs which form current supply terminals as well as serving for securing the emitter.

2. Description of the Prior Art

In directly heated thermionic emitters, an unavoidable temperature gradient arises due to heat dissipation through the contacts. At the hottest points material evaporates in an intensified manner. The decrease of the cross-section of the current-carrying path that results leads to the failure of the emitter due to additional heating, melting or fusing.

Attempts have been made to achieve an optimally homogenous temperature distribution by forming the emitter appropriately and varying its conductor cross-section. The overheating at the hottest points is then lower, so that less material is evaporated, and the lifetime is prolonged accordingly. In practice, however, hot spots always remain, at which the emitter develops a fracture, even if after a longer period of time.

SUMMARY OF THE INVENTION

It is an object of the present invention to provide a thermionic emitter of the type described above which achieves an optimally long lifetime prior to a time at which it inevitably fails.

This object is achieved in accordance with the invention in a thermionic emitter of the type initially described, wherein the legs each have a portion having a larger longitudinal electrical resistance (Ω/mm) than that of the conductor sections of the emission surface, with the result that areas of maximum temperature are shifted from the middle of the emission surface to its edges as the heating current increases.

The invention is based on the recognition that, in the operation of an X-ray tube, for which such thermionic emitters are highly suitable, the tube current fluctuates according to the application and the nature of the subject that is irradiated. By virtue of the heat discharge via the legs and the resulting heat sink, when the heating current is low the heat discharge via the legs prevails, so that the hottest point is situated in the center of the emission surface. As the tube current increases, the inventive reduction of the electrical resistance in the area of the legs achieves an additional heating in this area, which counteracts the heat discharge and leads to a shift of the temperature maximum from the center of the emission surface to its edge. Ideally the shift of the hottest point should spread over nearly all areas of the emission surface depending on the temperature of the emitter and thus on the tube current, so that in normal operation the areas of intensified evaporation migrate over the entire emission surface, and thus the undesirable melting of a stationary area having an elevated temperature can no longer occur. In this case, material does not evaporate only at one point in an intensified manner; rather, the depletion of material is distributed over a larger surface area. The resulting small change in cross-section leads to an extended lifetime of the emitter.

In a preferred embodiment of the invention, the elevated electrical resistance which is required for the purpose of realizing a temperature-dependent position of the hottest point of the emission surface is achieved forming the portions that have an elevated electrical resistance by means of a reduced cross-section compared to the cross-section of the conductor sections. Preferably, the reduced cross-section is realized by a reduced width of the portions. However, in addition to this, or alternatively, it is possible to bring about the reduction in cross-section by reducing the thickness of the portions, for example by etching.

According to another preferred variant of the invention, the portions having an elevated electrical resistance are situated in the respective areas of the junctions between the legs and the emission surface. When heating currents are low, the function of the portions of elevated electrical resistance as a heat source assumes secondary importance to the fact that the legs function as a heat sink due to the fact that heat is discharged via the legs. As a result, the emission surface has the highest temperature in its middle area. As heating current increases, the function of the portions of reduced electrical resistance as heat sources assumes a primary role, so that the hottest point of the emission surface migrates toward the exterior in the direction of the edge of the emission surface, particularly into the areas of the junctions of the emission surface and the legs.

DESCRIPTION OF THE DRAWING

The single FIGURE is a plan view of an exemplary embodiment of an inventive thermionic emitter with a flat emission surface in the initial state, that is, prior to angling the legs.

The thermionic emitter shown in the figure is a flat, round tin sheet with formed legs 2, which are angled 90° for installation and simultaneously serve as support elements via which the heating current and the cathode high voltage are applied. The tin piece is subdivided by slits 3 and 4 into spiral conductor sections, through which the heating current flows from one leg 2 to the other leg 2 via the midpoint of the emission surface, thereby producing a flat emission surface 1 from which electrons are emitted during operation. The conductor sections have a longitudinal electrical resistance $E'_i$ (Ω/mm) which is substantially constant along the entire length of the conductor segments.

Due to the heat sink that arises at the legs 2 by virtue of the heat discharge into those regions to which the legs 2 are attached, in the case of the exemplary embodiment, when the heating currents are small (e.g. below 50 mA), the point 5 of maximum temperature is situated in the middle of the emission surface 1, which is indicated by a black dot.

The emitter is inventively designed such that, in the respective areas between the legs 2 and the emission surface 1 that is formed by the conductor sections, each leg 2 has a portion 6 with a longitudinal electrical resistance $R'_2$ that is larger than the longitudinal electrical resistance $R'_1$ that prevails in area of the conductor sections. The elevated longitudinal resistance $R'_2$ is achieved by a reduced cross-section of the legs 2 in the cited junction area. This can be achieved either by each leg 2 having a portion 6 with a reduced width (as represented in the figure by broken lines), or by reducing the thickness of each leg 2 in the portion 6, for instance by etching. Due to the more intense heat formation in the portions 6 when the heating current is higher, the maximum temperature occurs at approximately 200 mA at two points 7, which are each characterized by a circle. When heating current is still higher, e.g. higher than 300 mA, the maximum temperature occurs in the junction areas to the legs 2, which are represented as small squares and are referenced 8.

Because of this migration of the point(s) of maximum temperature of the emission surface 1 depending on the heating current, the elevated loading and evaporation in the area of the point(s) of maximum temperature does not always occur at the same location; rather, because of the fact that the emitter is continually operated with different heating currents during its lifetime, this location is distributed over the emission surface 1, so that a longer lifetime of the emitter is achieved.

Although modifications and changes may be suggested by those skilled in the art, it is the intention of the inventors to embody within the patent warranted hereon all changes and modifications as reasonably and properly come within the scope of their contribution to the art.

We claim as our invention:

1. A thermionic emitter comprising:

a substantially flat emission surface subdivided by a plurality of slits into a plurality of conductor sections;

two electrically conductive legs connected to and proceeding from said emission surface for supplying current to said emission surface and for mounting said emission surface; and each of said legs having a portion thereof with an elevated longitudinal electrical resistance compared to a longitudinal electrical resistance of said conductor sections.

2. A thermionic emitter as claimed in claim 1 wherein each said portion of each of said legs has a reduced cross-section compared to a remainder of the leg.

3. A thermionic emitter as claimed in claim 1 wherein each said portion of each of said legs has a reduced width compared to a remainder of the leg.

4. A thermionic emitter as claimed in claim 1 wherein each portion of each of said legs is disposed adjacent a junction area between the leg and the emission surface.

5. A thermionic emitter as claimed in claim 1 wherein said slits are spiral slits which subdivide said emission surface into spiral conductor sections.

6. A thermionic emitter as claimed in claim 1 wherein said slits subdivide said emission surface into serpentine conductor sections.

* * * * *